US007442677B1

(12) United States Patent
Wagner

(10) Patent No.: US 7,442,677 B1
(45) Date of Patent: Oct. 28, 2008

(54) ACTIVATED PEROXIDE SOLUTION WITH IMPROVED STABILITY USEFUL FOR THE DECONTAMINATION OF CHEMICAL WARFARE AGENTS

(75) Inventor: George W. Wagner, Elkton, MD (US)

(73) Assignee: The United States of America as Represented by the Secretary of the Army, washington, DC (US)

( * ) Notice: Subject to any disclaimer, the term of this patent is extended or adjusted under 35 U.S.C. 154(b) by 0 days.

(21) Appl. No.: 11/217,847

(22) Filed: Aug. 24, 2005

Related U.S. Application Data

(60) Provisional application No. 60/604,382, filed on Aug. 25, 2004.

(51) Int. Cl.

| | |
|---|---|
| ***B08B 3/04*** | (2006.01) |
| ***C11D 7/12*** | (2006.01) |
| ***C11D 7/38*** | (2006.01) |
| ***C11D 7/54*** | (2006.01) |

(52) U.S. Cl. ..... 510/238; 422/28; 510/239; 510/245; 510/255; 510/372; 510/509; 134/42

(58) Field of Classification Search ..... 510/505, 510/175, 202, 365; 588/200
See application file for complete search history.

(56) References Cited

U.S. PATENT DOCUMENTS

| | | | | |
|---|---|---|---|---|
| 5,869,440 | A * | 2/1999 | Kobayashi et al. | 510/372 |
| 5,904,734 | A * | 5/1999 | Friberg et al. | 8/111 |
| 6,245,957 | B1 * | 6/2001 | Wagner et al. | 588/316 |
| 6,723,891 | B1 * | 4/2004 | Wagner et al. | 588/316 |
| 2003/0158459 | A1 * | 8/2003 | Tucker | 588/200 |
| 2004/0022867 | A1 * | 2/2004 | Tucker et al. | 424/616 |
| 2005/0037936 | A1 * | 2/2005 | Martyak et al. | 510/175 |

* cited by examiner

*Primary Examiner*—Gregory R Del Cotto
(74) *Attorney, Agent, or Firm*—Ulysses John Biffoni

(57) ABSTRACT

A chemical solution and process for the decontamination of chemical warfare agents. More particularly, a process for the decontamination of the vesicant HD by oxidation to its corresponding sulfoxide and nerve agents VX and GD by perhydrolysis to their non-toxic phosphonic acids using environmentally safe reactants, specifically a citrate/bicarbonate/molybdate peroxide solution.

21 Claims, No Drawings

ACTIVATED PEROXIDE SOLUTION WITH IMPROVED STABILITY USEFUL FOR THE DECONTAMINATION OF CHEMICAL WARFARE AGENTS

CROSS REFERENCE TO RELATED APPLICATIONS

This application claims priority from U.S. Provisional Application No. 60/604,382, filed Aug. 25, 2004, herein incorporated by reference in its entirety.

GOVERNMENT INTEREST

The invention described herein may be manufactured, used and licensed by or for the U.S. Government.

BACKGROUND OF THE INVENTION

1. Field of the Invention

The invention relates to decontamination of chemical warfare agents. More particularly, the invention relates to the decontamination of mutated agents such as HD by oxidation, as well as nerve agents such as VX and GD by perhydrolysis, using environmentally safe activated hydrogen peroxide. The peroxide is activated at lower pH, thus rendering it more stable than such prior decontaminating solutions.

2. Background

Several types of toxic chemical compounds are known to be useful as chemical warfare agents. These include mustard agents or gases known as blister agents, such as bis-(2-chloroethyl) sulfide, also known as HD, and nerve agents such as pinacolyl methylphosphonofluoridate, which is also known as GD, and O-ethyl S-(2-diisopropylamino)ethyl methylphosphonothioate, which is known as VX. HD is a colorless, oily liquid that is highly insoluble in water, and is a powerful vesicant which primarily affects the eyes and the lungs, blisters the skin and is considered a carcinogen. HD is also cytotoxic to hematopoietic tissue and can be lethal at high doses. GD and VX are powerful nerve agents that attack the nerve cells and impair the functioning of the central nervous system.

In order to decontaminate the vesicant mustard gas to render it non-toxic, it is necessary to oxidize it to the corresponding sulfoxide. Nerve agents such as VX and GD are rendered non-toxic by perhydrolysis to their non-toxic phosphonic acids. For example, the oxidation of HD to HD-sulfoxide (HDO) renders the gas non-toxic. One effective way to conduct this oxidation reaction is by reacting the agent with peroxide compounds.

Mildly-basic peroxide is also known to effect the perhydrolysis of VX and GD to their non-toxic phosphonic acids. Peroxides are desirable reactants for decontamination because they are non-toxic and non-corrosive, as compared to hypochlorite-based processes which are toxic and environmentally harmful. Additionally, peroxides are preferable because of their extremely low freezing points. However, while it is desirable to decontaminate chemical warfare agents by oxidation in a peroxide system, presently known systems are inefficient decontaminates because they cause secondary oxidation of the corresponding sulfoxide to a sulfone, a toxic vesicant. For example, HD-sulfoxide is a non-vesicant, while HD-sulfone is a highly toxic vesicant material. Also, known peroxide systems using hydrogen carbonate ions as an activator are inefficient because the oxidation reaction is very slow. However, hydrogen carbonate activator is efficient at generating peroxy anion ($OOH^-$) for VX and GD perhydrolysis. The oxidation reaction of HD may be greatly enhanced using molybdate activator, which selectively oxidizes HD to its sulfoxide, while avoiding the formation of HD sulfone. Additionally, molybdate does not interfere with the rapid, simultaneous perhydrolysis of VX and GD. Thus, bicarbonate and molybdate activators, in combination with hydrogen peroxide, provide for the fast and efficient decontamination of both nerve agents VX and GD and blister agent HD. However, such solutions of hydrogen peroxide activated with bicarbonate and molybdate are not stable for extended periods of time as hydrogen peroxide is not stable at basic pH.

U.S. Pat. No. 6,245,957 to Wagner et al., incorporated by reference, discloses a chemical warfare agent decontaminating composition of a mixture of a carbonate component, a peroxide component and an alcohol component effective to degrade a chemical warfare agent.

U.S. Pat. No. 6,723,891 to Wagner et al., incorporated by reference, discloses a process for the decontamination of chemical warfare agents, such as a process for the decontamination of the vesicant HD by oxidation to its corresponding sulfoxide and nerve agents VX and GD by perhydrolysis to their non-toxic phosphonic acids using environmentally safe reactants, specifically a peroxomolybdate compound having a dominant tetraperoxomolybdate species and peroxy anion.

SUMMARY OF THE INVENTION

Applicants now have discovered a decontamination system that utilizes a citrate/bicarbonate/molybdate/peroxide reactant system that affords increased stability over extended periods of time while maintaining excellent reactivity for nerve agents VX and GD and blister agent HD. It has a lower pKa than carbonic acid ($pK_2$–10.329, $pK_1$=6.352), citric acid ($pK_3$=9.2, $pK_2$=4.8, $pK_1$=3.1) to provide buffering at lower pH, thus providing for increased hydrogen peroxide stability, while still allowing for sufficient activation of hydrogen peroxide to peroxyanion ($OOH^-$) to react with nerve agents VX and GD. Citrate is also tribasic, thus providing for a higher buffering capacity compared to (dibasic) carbonate. Applicants have further found that citrate does not interfere with the molybdate-activated, selective oxidation of blister agent HD to its non-vesicant sulfoxide. Finally, citrate is suitable for use in solvent/surfactant solutions of hydrogen peroxide which provide for the ready dissolution of chemical warfare agents, in particular water-insoluble blister agent HD. Typical solvent/surfactant solutions are disclosed by Wagner et al. U.S. Pat. No. 6,245,957 and Wagner et al., U.S. Pat. No. 6,723,891, each of which is hereby incorporated by reference in its entirety. Carbonate may replace or be employed in addition to bicarbonate.

DETAILED DESCRIPTION OF THE INVENTION

The invention pertains to a process for decontaminating vesicant compounds and nerve agents used as chemical warfare agents. The chemical warfare agents are decontaminated by contacting the agent with a sufficient amount of a citrate/bicarbonate/molybdate solution in hydrogen peroxide/solvents/surfactants for a sufficient time and under conditions sufficient to produce a non-toxic reaction product. As mentioned above, carbonate may replace, or be used in addition to, bicarbonate. The present invention has a broad-spectrum of reactivity toward a variety of chemical warfare agents, while achieving a significant reduction in the toxic, corrosive and environmentally harmful nature of other known decontaminants. The invention is useful for decontaminating vesicant mustard gases and for decontaminating G and V nerve agents having the following generic formulas; G: ROP(O)($CH_3$)F, wherein R is either 2-propyl (GB), pinacolyl (GD), or cyclohexyl (GF); V: R"OP(O)($CH_3$)SR', wherein R" is ethyl and R' is 2-(diisopropylamino) ethyl (VX). More particularly, the chemical warfare agents decontaminated herein include mustard agent bis(2-chloroethyl) sulfide (HD), and nerve agents pinacolyl methylphosphonofluoridate (GD) and O-ethyl S-[2-(diisopropylamino)ethyl] methylphosphonothioate (VX).

The process includes forming a citrate/bicarbonate/molybdate solution in hydrogen peroxide and suitable aqueous and/or organic solvents and surfactants. Although "bicarbonate" is described throughout this specification, it is understood that the bicarbonate can be replaced by a carbonate, even though carbonate increases pH and may decrease stability. The preferred medium is a microemulsion containing hydrogen peroxide such as described by U.S. Pat. Nos. 6,245,957 and 6,723,891, herein incorporated by reference in its entirety. Normal solutions, for example those also disclosed by U.S. Pat. No. 6,245,957, are also suitable in the present invention. The peroxide component is preferably present in the microemulsion at from about 1 to about 25 weight percent, more preferably from about 5 to about 20 weight percent, and most preferably from about 8 to about 15 weight percent. When preferred ratios of ingredients, i.e., activator salts, hydrogen peroxide, surfactant, water, and solvents are present; the microemulsion appears as a clear, homogeneous solution.

In general, a microemulsion is a transparent or translucent, thermodynamically stable, isotropic dispersion of two immiscible liquids with microdomains of one or both liquids stabilized by an interfacial film of surface-active molecules. It typically comprises water, at least one organic solvent (oil), at least one surfactant, and in most cases at least one co-solvent. The surfactant may be anionic, cationic, non-ionic, amphoteric or zwitterionic. The water-in-oil microemulsions are roughly spherical water microdroplets coated by an interfacial film of a surfactant, e.g. sodium dodecyl sulfate (SDS), and a co-solvent, e.g. butanol (BuOH), and dispersed in a continuous phase of oil, e.g. hexane. Other suitable surfactants non-exclusively include cetyl trimethylammonium chloride (CTAC), and polyoxyethylene ethers, such as polyoxyethylene(10) isooctylphenyl ether (TRITON X-100). Of these, polyoxyethylene ethers are preferred. Other suitable co-solvents non-exclusively include 2-propanol, 2-methyl-1-propanol and propylene carbonate. Of these propylene carbonate is preferred. The microemulsion may also further include at least one carbonate and/or bicarbonate activator as described above. The hydrogen peroxide is generally added in batches to the medium. It generates $O_2$, but also some water as a side product derived both from the disproportionation and from the water of dilution of hydrogen peroxide.

The microemulsion should ideally be designed to meet three requirements: no phase separation during storage and during the oxidation reaction, high solubility of the reactants (e.g., peroxide and molybdate components), and simple recovery of the oxidized product, surfactant, and catalyst (molybdate compound) at the end of the reaction. The water-surfactant medium may include any of the surfactants described above, and may further include one or more co-solvents from the list described above.

In the preferred embodiment of the invention, the microemulsion exhibits stability at a temperature of from about 49° C. to about −25° C., more preferably from about 35° C. to about −10° C., and most preferably from about 25° C. to about 0° C. Additionally, the microemulsion is preferably maintained at a pH of from about 7 to about 12, more preferably from about 7.5 to about 11, and most preferably from about 8 to about 9.

In use, the compound, mixture or emulsion may be applied in the form of a spray, a vapor, a liquid, a solid, and/or other physical forms of mixtures that incorporate the peroxide and molybdate components of the decontaminant. Preferably the compound is present as a liquid or as a spray. For the compound to be applied in a liquid form, it is necessary to disperse the compound in a suitable medium. In one preferred embodiment of the invention, the compound is dispersed in a water-oil microemulsion. In this embodiment, the oil preferably comprises non-toxic propylene carbonate.

The citrate component of the invention may be comprised of an alkali metal citrate salt. The alkali metal preferably comprises a metal selected from the group consisting of Li, Na, K, Rb, Cs, Fr. More preferably, the alkali metal comprises either lithium (Li), sodium (Na) or potassium (K). Most preferably the citrate component comprises a citrate potassium salt, particularly $C_6H_5K_2O_7$. The citrate component is preferably present in the microemulsion at a concentration of from about 0.001 M to about 2.0 M, more preferably from about 0.01 M to about 1.0 M, and most preferably from about 0.1 M to about 0.8 M.

The reaction of the citrate component and the peroxide component may be further activated with carbonate/bicarbonate and/or molybdate activators. Carbonate activators are described by U.S. Pat. Nos. 6,245,957 and 6,723,891. Molybdate activators are described by U.S. Pat. No. 6,723,891. Such activators are preferably added to the solution and are incorporated into the emulsion.

The carbonate/bicarbonate activators work to enhance the perhydrolysis of nerve agents VX and GD to their corresponding phosphonic acids. The molybdate activator serves to enhance the oxidation of blister agent HD, selectively, to the non-vesicant sulfoxide. The carbonate and/or bicarbonate activator preferably is present in the microemulsion in an amount of from about 0.01 M to about 2.0 M, more preferably from about 0.1 M to about 1.0 M, and most preferably from about 0.2 M to about 0.8 M. The molybdate activator preferably is present in the microemulsion in an amount of from about 0.0001 M to about 0.1 M, more preferably from about 0.001 M to about 0.05 M, and most preferably from about 0.005 M to about 0.02 M. Preferably, the amount of molybdate is about 0.01 M to 0.02 M.

The peroxide component may be any suitable source of peroxide, for example those disclosed by U.S. Pat. Nos. 6,245,957 and 6,723,891.

In use, the citrate/bicarbonate/molybdate hydrogen peroxide microemulsion may be applied in the form of a spray, a vapor, a liquid, a solid, and/or other physical forms of mixtures that incorporate the peroxide and citrate/bicarbonate/molybdate components of the decontaminant. Preferably the microemulsion is present as a liquid or as a spray. For the citrate/bicarbonate/molybdate activators to be applied in a liquid form, it is necessary to disperse the compound in a suitable medium. In one preferred embodiment of the invention, the citrate/bicarbonate/molybdate activators are dispersed in a microemulsion. An example of a suitable microemulsion is described by U.S. Pat. No. 6,723,891.

Once the citrate/bicarbonate/molybdate activators are blended with hydrogen peroxide in a suitable medium, the resulting solution, or solution incorporated into a microemulsion, is contacted with at least one chemical warfare agent having a formula described above. The contact may be accomplished by immersing a chemical warfare agent covered article into the solution/microemulsion, spraying the solution/microemulsion onto an article, or other means for reacting the solution/microemulsion with the chemical warfare agent. The agent is contacted with the solution/microemulsion for a time and under conditions sufficient to neutralize the agent into non-toxic product(s). For example, when the blister agent mustard gas (HD), bis(2-chloroethyl) sulfide, is contacted with the solution/microemulsion of the invention, it is oxidized to its corresponding sulfoxide.

The following non-limiting example serves to illustrate the invention.

EXAMPLE

Potassium citrate monohydrate, $KHCO_3$, $K_2MoO_4$, propylene glycol, propylene carbonate, TRITON X-100, and 35% by weight aqueous $H_2O_2$ were all obtained from commercial sources. Microemulsions (MEs) were mixed by first dissolving the solid ingredients (e.g., potassium citrate monohydrate, $KHCO_3$ and $K_2MoO_4$) in water. To this, a mixture of propylene glycol, TRITON X-100 and propylene carbonate was added. Finally 35% $H_2O_2$ was added. The vessel holding the components was capped and vigorously shaken to mix. The decontamination solution thus formed was used to decontaminate VX, HD and GD in stirred reactors using a 50 mL amount of decontaminant and a 1 mL challenge of agent. The rates of neutralization for HD, VX and GD agents are shown in Table 1 for a decontaminating solution containing 10 vol % propylene carbonate, 20 vol % propylene glycol, 10 vol % TRITON X-100, 30 vol % hydrogen peroxide (35% aqueous solution used), and 30 vol % of an aqueous solution of potassium citrate monohydrate, potassium bicarbonate and potassium molybdate such that the final concentrations of these activators in the decontaminating solution were 0.25 M, 0.5 M and 0.02 M, respectively. The amount of agent (HD, VX AND GD initially present) to decontaminant is 1:50 or 2 vol. %.

TABLE I

Neutralization of HD, VX and GD in Citrate/Bicarbonate/Molybdate Microemulsions (volume percent)

| Time | HD | | | VX | | | GD | | |
|---|---|---|---|---|---|---|---|---|---|
| (mm) | R1 | R2 | R3 | R1 | R2 | R3 | R1 | R2 | R3 |
| 10 | 4.5 | 3.1 | 32.2 | 1.6 | 1.1 | 1.8 | 0.0 | 0.0 | 0.0 |
| 20 | 0.0 | 0.0 | 1.3 | 0.0 | 0.0 | 0.0 | — | — | — |
| 30 | — | 0.0 | 0.0 | — | — | — | — | — | — |
| 40 | — | — | — | — | — | — | — | — | — |
| 50 | | — | — | — | — | — | — | — | — |
| 60 | — | — | — | — | — | — | — | — | — |

Three stirred reactors (e.g., R1, R2 and R3) run in triplicate in room temperature. The percentage of the amount of original agent remaining over time is reported.

As can be clearly seen by the data in Table 1, all three agents, including blister agent HD and both nerve agents VX and GD, are rapidly neutralized at room temperature.

While the present invention as been particularly shown and described with reference to preferred embodiments, it will be readily appreciated by those of ordinary skill in the art that various changes and medications may be made without departing from the spirit and scope of the invention. It is intended that the claims be interpreted to cover the disclosed embodiment, those alternatives which have been discussed above and all equivalents thereto.

I claim:

1. A process for decontaminating a chemical warfare agent, comprising: contacting the chemical warfare agent with a liquid decontamination solution, the decontamination solution comprising a mixture of a potassium citrate salt, a carbonate component, potassium molybdate and a peroxide component, wherein the carbonate component comprises at least one member selected from the group consisting of carbonate and bicarbonate, and wherein said potassium citrate salt increases the stability of the decontamination solution.

2. The process of claim 1, wherein the chemical warfare agent is selected from the group consisting of mustard agents, nerve agents and blister agents.

3. The process of claim 1, wherein the chemical warfare agent is selected from the group consisting of: bis-(2-chloroethyl) sulfide (HD); pinacolyl methylphosphonofluoridate (GD); and O-ethyl S-(2-diisopropylamino)ethyl methylphosphonothioate (VX).

4. The process of claim 1, wherein the chemical warfare agent is selected from the group consisting of: $ROP(O)(CH_3)F$, wherein R is either 2-propyl, pinacolyl, or cyclohexyl; $R''OP(O)(CH_3)SR'$, wherein R" is ethyl and R' is 2-(diisopropylamino) ethyl; and bis(2-chloroethyl) sulfide.

5. The process of claim 1, further comprising forming the decontamination solution by reacting the peroxide component and the potassium citrate salt, bicarbonate, molybdate and optionally adding one or more solvents and surfactants.

6. The process of claim 1, further comprising activating the decontamination solution.

7. The process of claim 1, wherein the carbonate component comprises bicarbonate.

8. The process of claim 1, wherein the peroxide component comprises hydrogen peroxide or a suitable source thereof.

9. The process of claim 1, wherein said contacting step comprises applying a microemulsion of said decontamination solution.

10. The process of claim 1, wherein said potassium citrate salt comprises potassium citrate monohydrate.

11. A solution for decontaminating chemical warfare agents, comprising:

a liquid mixture of a potassium citrate salt; a carbonate component comprising at least one member selected from the group consisting of a bicarbonate and carbonate; potassium molybdate; a solvent; and a peroxide component, and wherein said potassium citrate salt increases the stability of the solution.

12. The solution of claim 11, wherein said solvent further comprises at least one solvent selected from the group consisting of organic solvents and surfactants.

13. The solution of claim 11, further comprising an activator.

14. The solution of claim 11, wherein the carbonate component comprises bicarbonate.

15. The solution of claim 11, wherein the peroxide component comprises hydrogen peroxide or a suitable source thereof.

16. The solution of claim 11, wherein the peroxide component comprises hydrogen peroxide.

17. The solution of claim 11, wherein said solution is in the form of a microemulsion.

18. The solution of claim 17, wherein the hydrogen peroxide is present in the microemulsion in an amount from about 1 to about 25 weight percent.

19. The solution of claim 17, wherein the microemulsion is in the form of a spray or a liquid.

20. The solution of claim 11, wherein the potassium citrate salt is present in a concentration of from about 0.001 M to about 2.0 M.

21. The solution of claim 11, wherein said potassium citrate salt comprises potassium citrate monohydrate.

* * * * *